US006295892B1

(12) United States Patent
Roy et al.

(10) Patent No.: US 6,295,892 B1
(45) Date of Patent: Oct. 2, 2001

(54) LOCKABLE LEVER ARM ASSEMBLY

(75) Inventors: Normand Roy, St-Hugues; Yves St-Pierre, Drummondville, both of (CA)

(73) Assignee: Soucy International Inc., Drummondville (CA)

( * ) Notice: Subject to any disclaimer, the term of this patent is extended or adjusted under 35 U.S.C. 154(b) by 0 days.

(21) Appl. No.: 09/349,167

(22) Filed: Jul. 9, 1999

(51) Int. Cl.[7] ..... G05G 5/06; G05G 1/00
(52) U.S. Cl. ..... 74/532; 74/491
(58) Field of Search ..... 74/491, 527, 532

(56) References Cited

U.S. PATENT DOCUMENTS

| | | | | |
|---|---|---|---|---|
| 2,629,944 | | 3/1953 | Arps | 37/42 |
| 3,799,447 | * | 3/1974 | Beal | 239/288.5 |
| 3,858,662 | | 1/1975 | Reid | 172/297 |
| 4,008,626 | * | 2/1977 | Schulte et al. | 74/532 X |
| 4,024,663 | * | 5/1977 | Baker | 42/67 |
| 4,025,000 | * | 5/1977 | Blasnik | 239/459 |
| 4,150,586 | * | 4/1979 | Mueller, Jr. | 74/532 |
| 5,161,657 | * | 11/1992 | Papenhagen et al. | 74/532 X |
| 5,329,708 | | 7/1994 | Segorski et al. | 37/231 |
| 5,426,882 | * | 6/1995 | Dornaus | 42/100 |
| 5,615,745 | | 4/1997 | Cross | 172/811 |
| 5,746,275 | | 5/1998 | Cross et al. | 172/440 |

FOREIGN PATENT DOCUMENTS

| | | | | |
|---|---|---|---|---|
| 635035 | * | 3/1950 | (GB) | 74/532 |

* cited by examiner

*Primary Examiner*—Charles A Marmor
*Assistant Examiner*—Roger Pang
(74) *Attorney, Agent, or Firm*—Bourque & Associates, P.A.

(57) ABSTRACT

The assembly (10) is for use with a mechanical leverage system (24) mounted on a frame (14), for instance the frame of a vehicle (12), to move an implement (16) between a lowered position and a lifted position. The assembly (10) comprises an elongated first lever arm (30) and a second lever arm (40) that is in motion-transmitting engagement with a lower end (32) of the first lever arm (30). A detent member (50) is provided to lock the second lever arm (40) in an intermediary position located between a first and a second limit position thereof. The intermediary position corresponds to the lifted position of the implement (16). The detent member (50) is released by further pivoting the first lever arm (30) so as to move the second lever arm (40) from its intermediary position to its second limit position. The detent member (50) is then released without having to independently operate a locking mechanism or to move the first lever arm (30) sidewards.

21 Claims, 3 Drawing Sheets

LOCKABLE LEVER ARM ASSEMBLY

BACKGROUND

The present invention relates to a lockable lever arm assembly for use with a mechanical leverage system mounted on a frame, such as the frame of a vehicle, to move an implement between a lowered position and a lifted position.

An implement is broadly defined as a tool or an instrument operatively connected to the frame of another object or structure, such as a vehicle. These implements are usually vertically movable between a lowered position and a lifted position. The lowered position generally corresponds to a ground-engaged position in the context of a vehicle.

The implements found on vehicles are typically used for cultivating, cutting grass or hay, plowing snow or earth, cleaning pavement, etc. Their size is generally proportional to that of the corresponding vehicle. Large implements require powerful lifting mechanisms provided with a hydraulic actuator. However, smaller implements may only require a lifting mechanism using the muscular force of the operator as the power source. Such implements are generally found on all-terrain vehicles (ATV) or garden tractors. Portable industrial devices may also be provided with a lifting mechanism of this kind. A lift handle is made accessible to the operator and the vertical position of the implement is changed by changing the position of the lift handle.

Conventional small lifting mechanisms have more or less complicated arrangements for maintaining an implement in the lifted position against its own weight. For instance, some use a toothed rack while others use a side locking pin that holds the lift handle in place. These locking mechanisms require that the operator pushes a button or moves the lift handle sidewards to lock it at or release it from its lifted position.

SUMMARY

It is an object of the present invention to provide a simple and efficient lockable lever arm assembly that, when used with a mechanical leverage system mounted on a frame, allows to easily move an implement between a lowered position and a lifted position. The movement is achieved by pivoting a lever arm in a single displacement plane, thus making it unnecessary to independently operate a locking mechanism or to move the lever arm sidewards for maintaining and releasing the implement.

More particularly, the present invention relates to a lockable lever arm assembly for use with a mechanical leverage system mounted on a frame to move an implement between a lowered position and a lifted position. The assembly comprises an elongated first lever arm pivotable in a first substantially vertical plane. The first lever arm has an upper end and a lower end. The lower end is pivotally connectable to the frame. A second lever arm is in motion-transmitting engagement with the lower end of the first lever arm. The second lever arm is movable in a second substantially vertical plane that is substantially parallel to the first plane. The second lever arm has an upper end and a lower end. The lower end of the second lever arm is pivotally connectable to the frame. Yet, the second lever arm is pivotable between a first limit position that corresponds to the lowered position of the implement, and a second limit position.

A detent member is further provided. The detent member is substantially coplanar with the second lever arm. It comprises an upper end that is pivotally connected to the frame, and a lower end that is in an interfering path with the upper end of the second lever arm. The lower end of the detent member is configured and shaped to receive and hold the upper end of the second lever arm in an intermediary position that is located between the first and second limit positions thereof. The intermediary position corresponds to the lifted position of the implement. At that point, an elastic stopper is slightly pressed by the second lever arm to maintain a firm contact between the second lever arm and the detent member.

In use, when the second lever arm is moved from its first limit position towards its second limit position, the lower end of the detent member holds the upper end of the second lever arm at the intermediary position to prevent it from returning to the first limit position until the detent member is released therefrom by pivoting the second lever arm from its intermediary position to its second limit position. This allows the second lever arm to be moved back to the first limit position. The elastic stopper is further pressed by the second lever arm when it reaches the second limit position.

It is also an object of the present invention to provide a lockable lever arm assembly comprising first means for providing a leverage; second means for providing an anchorage point, the second means being movable between a first limit position, corresponding to the lowered position of the implement, and a second limit position; third means for connecting the first means to the second means in a motion-transmitting engagement; fourth means for holding the second means in an intermediary position by its anchorage point when the second means is moved from its first limit position towards its second limit position, the intermediary position corresponding to the lifted position of the implement and being located between the first and second limit positions of the second means, the fourth means being disengageable by further moving the second means from its intermediary position to its second limit position so that the second means then be free to move from its second limit position to its first limit position; and fifth means for connecting the lever arm assembly to the mechanical leverage system.

It is further an object of the present invention to provide a method for manually changing the position of an implement movable between a lowered position and a lifted position with the use of a lockable lever arm assembly that is mechanically connected to a mechanical leverage system. The method comprises the steps of:

(A) pivoting an elongated first lever arm in a first direction to initiate a movement of the implement from the lowered position to the lifted position, the first lever arm being connected to a second lever arm that is then pivoted from a first limit position, corresponding to the lowered position of the implement, toward a second limit position thereof;

(B) continuing to pivot the first lever arm until the second lever arm is slightly pressing against an elastic stopper and be received in a detent member for holding it at an intermediary position, located between the first and second limit positions of the second lever arm, which intermediary position corresponds to the lifted position of the implement;

(C) stopping to pivot the first lever arm to allow the detent member to hold the second lever arm and keep the implement in the lifted position against its weight;

(D) pivoting again the first lever arm in the first direction to further compress the stopper and move the second lever arm toward the second limit position in view of moving the implement from the lifted position toward the lowered position;

(E) stopping to pivot the first lever arm when the second lever arm reaches its second limit position and where the detent member is released from the second lever arm;

(F) pivoting the first lever arm in a second direction, opposite the first direction, during which the second lever arm moves from its second limit position to its first limit position; and (G) stopping to pivot the first lever arm when the second lever arm reaches its first limit position.

A non-restrictive description of a preferred embodiment will now be given with reference to the appended figures.

IDENTIFICATION OF THE COMPONENTS

Figure 1:
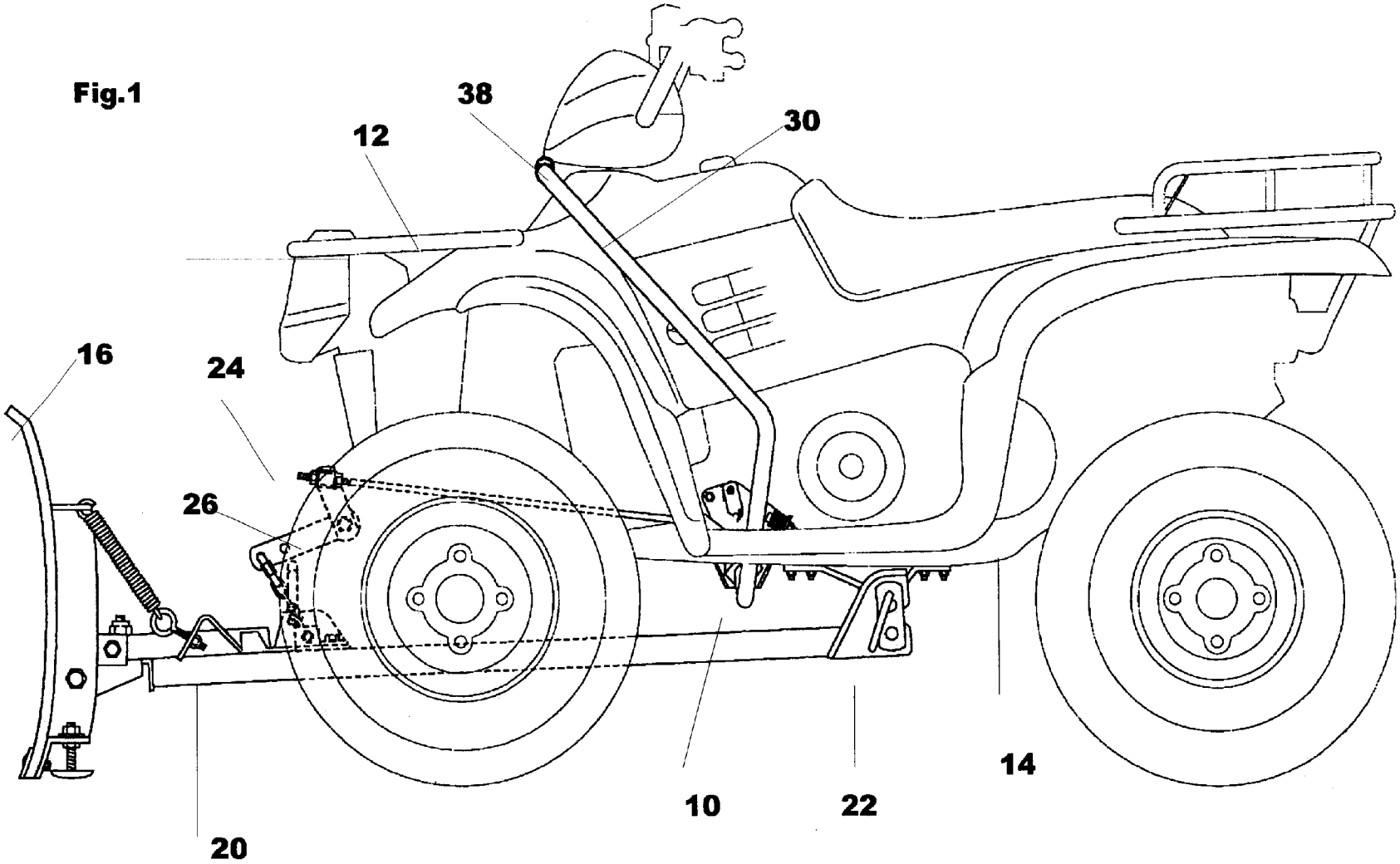
FIG. 1 is a side elevation view of a typical ATV that is provided with a lockable lever arm assembly according to a preferred embodiment of the invention.

The following is a list of the reference numerals, along with the names of the corresponding components, that are used in the appended figures and in the description. It should be noted that the parts shown in FIGS. 4 to 7 which are not referred to correspond to the same components than those shown in FIG. 3.

10 lockable lever arm assembly
12 all-terrain vehicle (ATV)
14 frame
16 implement
20 carriage assembly
22 fulcrum
24 mechanical leverage system
26 crank sub-assembly
28 pulling member
30 first lever arm
32 lower end (of the first lever arm)
34 upper end (of the first lever arm)
36 bracket
38 handle (of the first lever arm)
40 second leverarm
42 lower end (of the second lever arm)
44 upper end (of the second lever arm)
50 detent member
52 lower end (of the detent member)
53 spring
54 upper end (of the detent member)
60 stopper
62 spring (of the stopper)

DESCRIPTION

FIG. 1 shows a preferred embodiment of a lockable lever arm assembly (10) used on an all-terrain vehicle (ATV), referred to as numeral (12), having a frame (14) to which an implement (16) is operatively connected. The ATV (12) is only one example of a possible application for the lever arm assembly (10). The lever arm assembly (10) may also be used with other vehicles or with any other objects or structures.

The implement (16) in the illustrated embodiment is a blade for plowing matters such as snow or earth. Its relatively small size allows it to be lifted and lowered by using the muscular force of an operator sitting on the ATV (12), as explained later. A counterbalancing mechanism (not shown) may also be provided. Further, an actuator (not shown) can be provided to assist the operator or generate the whole lifting force.

The implement (16) is located in front of the ATV (12) and is attached to its frame (14) by means of a conventional carriage assembly (20). The implement (16) and a portion of the carriage assembly (20) are removably and pivotally connected to a fulcrum (22) located under the frame (14). The carriage assembly (20) is also connected to a mechanical leverage system (24) mounted on the frame (14).

The implement (16) is selectively movable between a lowered position and a lifted position, which means that the operator is free to move the implement (16) in every position, for instance from a lowered position to a lifted position or from a lifted position to a lowered position. These positions are selected by operating the lever arm assembly (10), located on one side of the ATV (12), and to which the implement (16) is indirectly connected by means of an elongated pulling member (28) operating a crank sub-assembly (26) of the leverage system (24). The pulling member (28) may be a rod, a wire, a chain or any other suitable components. Other kinds of carriage assemblies (20) and leverage systems (24) are also possible, as apparent to a person skilled in the art.

The most visible element of the lever arm assembly (10) is an elongated first lever arm (30) that is pivotable in a first substantially vertical plane to provide leverage. The exact shape of the first lever arm (30) depends in most part of the available space on the side of the ATV (12), more particularly the side of the fuel tank and the engine, and of the ergonomic design constrains. The first lever arm (30) preferably comprises a wedge-shaped portion extending in the vertical plane. Yet, the side is preferably the left side since the throttle handle is located on the right side of an ATV, such as the ATV (12) illustrated in FIG. 1.

Figure 2:
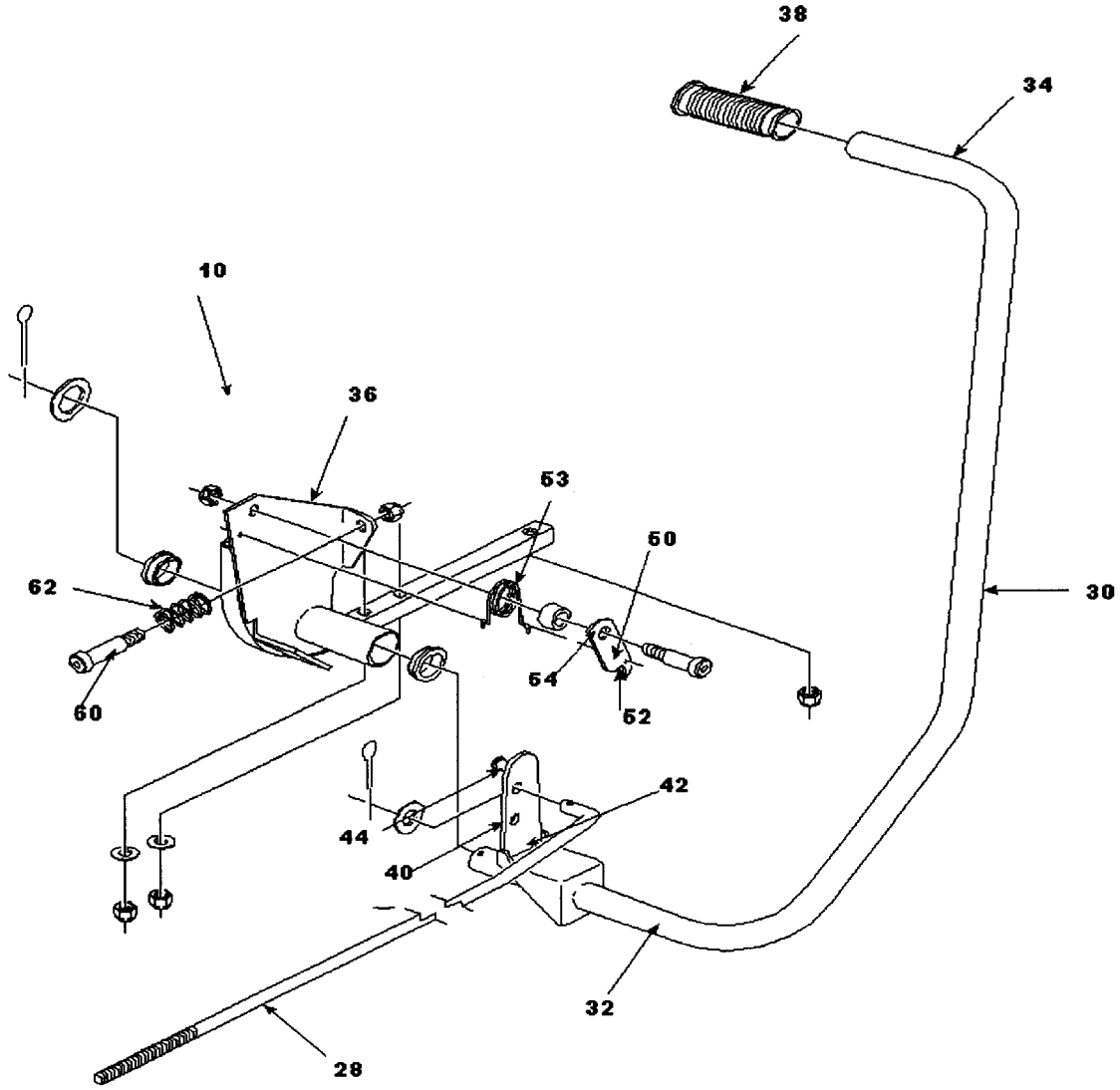
FIG. 2 is an exploded side view of the lever arm assembly shown in FIG. 1.

The first lever arm (30) has a lower end (32) and an upper end (34). The lower end (32) is directly or indirectly pivotally connectable to the frame (14). In the illustrated embodiment, and as best shown in FIG. 2, the lower end (32) of the first lever arm (30) is indirectly connected to the frame (14) by means of a bracket (36) that is attached to the frame (14). Moreover, the upper end (34) of the first lever arm (30), which is accessible to a driver sitting on the ATV (12), is preferably provided with a handle (38).

The lever arm assembly (10) further comprises a second lever arm (40) having a lower end (42) and an upper end (44). The lower end (42) of the second lever arm (40) is directly or indirectly pivotally connected to the frame (14). In the illustrated embodiment, the lower end (42) of the second lever arm (40) is indirectly connected to the frame (14) by means of the bracket (36).

The second lever arm assembly (10) is in motion-transmitting engagement with the lower end (32) of the first lever arm (30) so that any movement of the first lever arm (30) also moves the second lever arm (40). This is preferably achieved by rigidly connecting the lower end (32) of the first lever arm (30) to the lower end (42) of the second lever arm (40). The second lever arm (40) is connected to the side of the first lever arm (30) so that their respective planes of displacement are offset with reference to the other. Other arrangements are also possible, such as having the two planes aligned with each other and providing a linking element (not shown) between the parts.

The second lever arm (40) is significantly shorter than the first lever arm (30) to increase the torque due to the lever effect and to minimize the required space. It is pivotable in a second substantially vertical plane that is substantially parallel to the plane of the first lever arm (30).

The second lever arm (40) is pivotable between a first limit position and a second limit position. The first limit position corresponds to the lowered position of the implement (16). The main purpose of the second lever arm (40) is to provide an anchorage point for a holding device, as explained hereinafter. It may also be used as a connection point for one end of the pulling member (28). The pulling member (28) may also be directly connected to the first lever arm (30) since the first (30) and the second lever arm (40) are connected together.

The holding device in the lever arm assembly (10) is preferably a detent member (50). Other arrangements are also possible. The detent member (50) is substantially coplanar with the second lever arm (40). It comprises a lower end (52) and an upper end (54). The upper end (54) is pivotally connected, either directly or indirectly, to the frame (14). It is preferably connected at a location which is longitudinally offset, which is forward in the illustrated embodiment, with reference to the pivot axis of the second lever arm (40). In the illustrated embodiment, the upper end (54) of the detent member (50) is indirectly connected to the frame (14) by means of the bracket (36).

The detent member (50) is designed so that its lower end (52) be in an interfering path with the upper end (44) of the second lever arm (40), which means that they will be in contact with each other within a given range of positions. The lower end (52) of the detent member (50) is configured and shaped to receive and hold the upper end (44) of the second lever arm (40) in an intermediary position located somewhere between the first and second limit positions thereof. The intermediary position corresponds to the lifted position of the implement (16).

In the illustrated embodiment, the upper end (44) of the second lever arm (40) has rounded cross section. The lower end (52) of the detent member (50) has a corresponding shape to receive the upper end (44) of the second lever arm (40). The detent member (50) is thus capable of holding the upper end (44) of the second lever arm (40), when properly positioned, to maintain the implement (16) in the lifted position against its own weight. The second lever arm (40) is preferably vertically oriented at that moment.

An elastic stopper (60) is provided. This stopper (60) preferably comprises a spring (62) connected to the frame (14) or includes any other elastic arrangement, such as a resilient material. It has two main functions. First, the stopper (60) limits the movement of the second lever arm (40) at the second limit position. Then, the stopper (60) generates a small maintaining force between the second lever arm (40) and the detent member (50). This maintaining force prevents the second lever arm (40) and the detent member (50) from being accidentally disengaged from each other, for instance when the vehicle passes over a bump or travels on a rough terrain. Additionally, the stopper (60) provides a reference point for the operator about the exact location where the second lever arm (40) reaches its intermediary position. If the operator pulls the first lever arm (30) beyond the intermediary position of the second lever arm (40), the return force generated by the spring increases.

Figure 3:
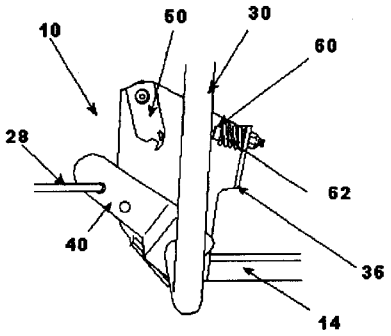
FIGS. 3 to 7 show the sequence of operation of the lever arm assembly shown in FIG. 1.
Figure 4:
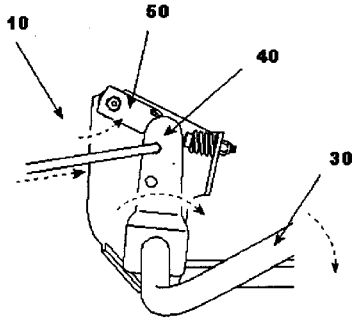
Figure 5:
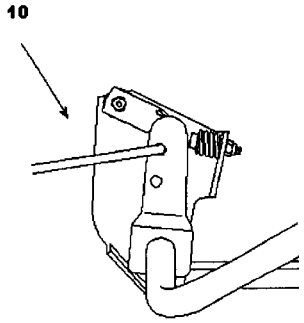

In use, the position of the implement (16) is changed by performing the following steps. First, when the implement (16) is at the lowered position, a lifting force is provided by the operator to pivot the first lever arm (30) in order to initiate the movement of the implement (16). The lever arm assembly (10) in the present example is initially as shown in FIG. 3. The second lever arm (40) is then moved from its first limit position toward its second limit position. As shown in FIG. 4, the upper end (44) of the second lever arm (40) interferes with the lower end (52) of the detent member (50) and forces it to pivot upwards. Before reaching the second limit position, the second lever arm (40) slightly presses against an elastic stopper and is simultaneously received in the detent member (50) that holds it at the intermediary position, as shown in FIG. 5. The lifting force is stopped at that moment and the detent member (50) keeps the implement (16) in the lifted position.

Figure 6:
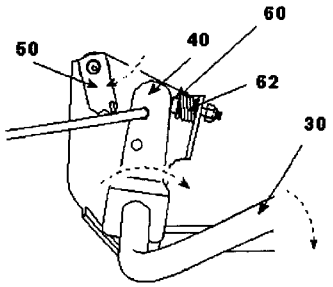

To change the position of the implement (16) from the lifted position to the lowered position, the operator provides again a lifting force by hand to pivot the first lever arm (30) in the same direction than the previous one, as shown in FIG. 6. This moves the second lever arm (40) to the second limit position and further compresses the stopper (60). The lifting force is interrupted when the second lever arm (40) reaches its second limit position. At that location, the detent member (50) is released from the second lever arm (40) since it is short enough to be disengaged from the second lever arm (40) as soon as the second lever arm (40) is moved from the intermediary position to the second limit position. The detent member (50) then pivots back to its original position by gravity and with the assistance of a torsion spring (53). Using only gravity or another arrangement is also possible.

Figure 7:
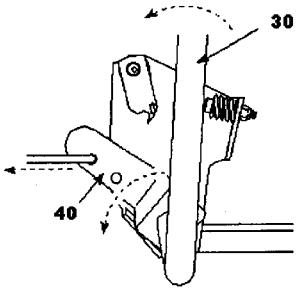

The operator finally provides a retaining force by hand to control the movement of the first lever arm (30) in the opposite direction and during which the second lever arm (40) moves from its second limit position to its first limit position, as shown in FIG. 7. The retaining force is stopped when the second lever arm (40) reaches its first limit position.

Although a preferred embodiment of the invention has been described in detail herein and illustrated in the accompanying figures, it is to be understood that the invention is not limited to this precise embodiment and that various changes and modifications may be effected therein without departing from the scope or spirit of the present invention.

What is claimed is:

1. A lockable lever arm assembly for use with a mechanical leverage system mounted on a frame to move an implement between a lowered position and a lifted position, the assembly comprising:

an elongated first lever arm pivotable in a first substantially vertical plane, the first lever arm having an upper end and a lower end, the lower end being pivotally connectable to the frame;

a second lever arm in motion-transmitting engagement with the lower end of the first lever arm and movable in a second substantially vertical plane that is substantially parallel to the first plane, the second lever arm having an upper end and a lower end, the lower end of the second lever arm being pivotally connectable to the frame, the second lever arm being pivotable between a first limit position corresponding to the lowered position of the implement, and a second limit position;

a detent member substantially coplanar with the second lever arm, the detent member comprising an upper end that is pivotally connected to the frame, and a lower end that is in an interfering path with the upper end of the second lever arm, the lower end of the detent member being configured and shaped to receive and hold the upper end of the second lever arm in an intermediary position located between the first and second limit positions thereof and corresponding to the lifted position of the implement; and an elastic stopper being slightly pressed by displacement the second lever arm at its intermediary position and being further pressed by it at its second limit position;

whereby, in use, when the second lever arm is moved from its first limit position towards its second limit position, the lower end of the detent member holds the upper end of the second lever arm at the intermediary position to prevent it from returning to the first limit position until the detent member is automatically disengaged therefrom solely by pivoting the second lever arm from its intermediary position to its second limit position, thereby allowing the second lever arm to be moved back to the first limit position.

2. A lockable lever arm assembly according to claim 1, wherein the upper end of the detent member pivots around a pivot axis that is longitudinally offset with reference to the pivot axis of the second lever arm.

3. A lockable lever arm assembly according to claim 2, wherein the upper end of the second lever arm has rounded cross section, the lower end of the detent member having a corresponding shape to receive the upper end of the second lever arm, the second lever arm being substantially vertical when held at the intermediary position.

4. A lockable lever arm assembly according to claim 1, wherein the stopper comprises a spring.

5. A lockable lever arm assembly according to claim 1, further comprising a spring to bias the detent member towards a resting position.

6. A lockable lever arm assembly according to claim 1, wherein the lower end of the first lever arm and the lower end of the second lever arm are rigidly connected together.

7. A lockable lever arm assembly according to claim 1, wherein the frame is the main fame of a vehicle.

8. A lockable lever arm assembly according to claim 7, wherein the upper end of the first lever arm is driver accessible during the operation of the vehicle.

9. A lockable lever arm assembly according to claim 1, wherein the first lever arm comprises a wedge-shaped portion extending in the vertical plane.

10. A lockable lever arm assembly according to claim 1, wherein the first and second planes are offset.

11. A lockable lever arm assembly according to claim 1, wherein the lever arm assembly further comprises a bracket to be rigidly connected the frame and to which are connected the lower end of the first and second lever arms and the upper end of the detent member.

12. A lockable lever arm assembly according to claim 1, further comprising a pulling member having one end connected to the second lever arm and another end to be attached to the mechanical leverage system.

13. A method for manually changing the position of an implement using a lockable lever arm assembly as claimed in claim 1, the method comprising the steps of:

(A) pivoting said elongated first lever arm in a first direction to initiate a movement of the implement from the lowered position to the lifted position, the first lever arm being connected to the second lever arm that is then pivoted from the first limit position, toward the second limit position thereof;

(B) continuing to pivot the first lever arm until the second lever arm is slightly pressing against said elastic stopper means and be received in the detent member for holding it at said intermediary position;

(C) stopping to pivot the first lever arm to allow the detent member to hold the second lever arm and keep the implement in the lifted position against its weight;

(D) pivoting again the first lever arm in the first direction to further compress the elastic stopper means and move the second lever arm toward the second limit position in view of moving the implement from the lifted position toward the lowered position;

(E) stopping to pivot the first lever arm when the second lever arm reaches its second limit position and where the detent member is released from the second lever arm;

(F) pivoting the first lever arm in a second direction, opposite the first direction, during which the second lever arm moves from its second limit position to its first limit position; and (G) stopping to pivot the first lever arm when the second lever arm reaches its first limit position.

14. A lockable lever arm assembly for use with a mechanical leverage system mounted on a frame to move an implement between a lowered position and a lifted position, the assembly comprising:

first means for providing a leverage;

second means for providing an anchorage point, the second means being movable between a first limit position, corresponding to the lowered position of the implement, and a second limit position;

third means for connecting the first means to the second means in a motion-transmitting engagement;

fourth means for holding the second means in an intermediary position by its anchorage point when the second means is moved from its first limit position towards its second limit position, the intermediary position corresponding to the lifted position of the implement and being located between the first and second limit positions of the second means, the fourth means being automatically disengageable solely by further moving the second means from its intermediary position to its second limit position so that the second means then be free to move from its second limit position to its first limit position; and fifth means for connecting the lever arm assembly to the mechanical leverage system.

15. A lockable lever arm assembly according to claim 14, wherein the fourth means comprise:

a detent member having an upper end pivotally connectable to the frame, the detent member being engageable with the second means so that the implement be held in its lifted position; and means for biasing the detent member toward a vertical position.

16. A lockable lever arm assembly according to claim 15, wherein the means for biasing the detent member toward a resting position comprises a spring.

17. A lockable lever arm assembly according to claim 15, wherein the first means comprise an elongated lever arm having a lower end pivotally connectable to the frame, the leverage being generated by a lever effect when a force is applied by hand at an upper end of the elongated lever arm.

18. A lockable lever arm assembly according to claim 17, wherein the second means comprise another lever arm that is significantly shorter than the elongated lever arm and which provides the anchorage point at an upper end thereof.

19. A lockable lever arm assembly according to claim 14, further comprising sixth means for generating a maintaining force between the second and fourth means when the second means are held by the fourth means at the intermediary position thereof, and for stopping the second means at the second limit position thereof.

20. A lockable lever arm assembly according to claim 19, wherein the sixth means comprise a stopper biased by a spring and connectable to the frame.

21. A method for manually changing the position of an implement using a lockable lever arm assembly as claimed in claim 14, the method comprising the steps of:

(A) pivoting said first means in a first direction to initiate a movement of the implement from the lowered position to the lifted position, the second means being then pivoted from the first limit position, toward the second limit position thereof;

(B) continuing to pivot the first means until the second means are received in the fourth means for holding it at said intermediary position;

(C) stopping to pivot the first means to allow the fourth means to hold the second means and keep the implement in the lifted position against its weight;

(D) pivoting again the first means in the first direction to move the second means toward the second limit position in view of moving the implement from the lifted position toward the lowered position;

(E) stopping to pivot the first means when the second means reach its second limit position and where the fourth means are automatically released from the second means;

(F) pivoting the first means in a second direction, opposite the first direction, during which the second means move from its second limit position to its first limit position; and (G) stopping to pivot the first means when the second lever means reach its first limit position.

* * * * *